US007669248B2

(12) United States Patent
Toratani

(10) Patent No.: US 7,669,248 B2
(45) Date of Patent: Mar. 2, 2010

(54) CLOTHING SUCH AS SHORTS OR BATHING SUIT

(76) Inventor: Ikuo Toratani, 28-4, Matsuhama Ni, Kahoku-shi, Ishikawa (JP) 929-1172

( * ) Notice: Subject to any disclaimer, the term of this patent is extended or adjusted under 35 U.S.C. 154(b) by 385 days.

(21) Appl. No.: 11/666,663

(22) PCT Filed: Jan. 25, 2006

(86) PCT No.: PCT/JP2006/001105

§ 371 (c)(1),
(2), (4) Date: May 1, 2007

(87) PCT Pub. No.: WO2007/086110

PCT Pub. Date: Aug. 2, 2007

(65) Prior Publication Data

US 2009/0049576 A1 Feb. 26, 2009

(51) Int. Cl.
*A41D 7/00* (2006.01)

(52) U.S. Cl. ..... 2/67; 2/400; 2/109; 2/73; 2/113; 2/406

(58) Field of Classification Search ..... 2/67, 2/406, 400, 113, 109, 73
See application file for complete search history.

(56) References Cited

U.S. PATENT DOCUMENTS 6,463,591 B1 * 10/2002 Toratani ..... 2/67
6,807,685 B1 * 10/2004 Hasegawa et al. ..... 2/406

FOREIGN PATENT DOCUMENTS

JP 57-205501 12/1982
JP 3389573 3/2003

* cited by examiner

*Primary Examiner*—Gary L Welch
*Assistant Examiner*—Alissa J Tompkins
(74) *Attorney, Agent, or Firm*—Bacon & Thomas, PLLC

(57) ABSTRACT

Continuousness and stability of an effect of preventing hip hemlines from rising in walking or a crouching posture are improved. A clothing has: a front body 11 and back body 12 which are stretchable; and a gusset 13 which is disposed between an inner crotch front portion 22 of the lower end of the front body 11 and an inner crotch rear portion 23 of the lower end of the back body 12, to cover a groin portion. The curvature of the rear end portion 13*b* which is formed in the gusset 13 into a convex arcuate shape is made larger than that of the inner crotch rear portion 23 which is formed in the lower end of the back body 12 into a concave arcuate shape, and the rear end portion 13*b* and the inner crotch rear portion 23 are stitched together to dispose a dart 26 which three-dimensinalizes so as to suit a bulged shape of a buttock lower portion.

2 Claims, 8 Drawing Sheets

CLOTHING SUCH AS SHORTS OR BATHING SUIT

TECHNICAL FIELD

The present invention relates to a clothing such as shorts, a bathing suit, a leotard, or briefs, and more particularly to a clothing such as shorts or a bathing suit in which a hip hemline does not rise especially in walking, a crouching posture, or the like, and which is comfortable to wear.

BACKGROUND ART

As a clothing such as shorts or a bathing suit in which a countermeasure for preventing the hip hemline from rising is taken, the applicant of the present application has proposed a clothing such as shown in FIGS. 5 to 7 (see Patent literature 1). In the shorts, lower end portions of right and left edges 32, 32 of a stretchable front body 31 are formed into curved edges 32*a* that are outward convex as shown in FIGS. 5 and 6, lower portions 34*a* of right and left edges 34, 34 of a back body 33 are cut into a shape which is spread as moving downward, the portions extending from vertical intermediate positions to lower end portions, and the both portions 32*a*, 34*a* are stitched together. According to the configuration, it is possible to obtain adequate three-dimensional bulges which are similar to the body shape in the vicinity of the hip hem, in a non-worn state. In a worn state, therefore, the hip hemlines 35 can deeply fit to the gluteal groove portion to deeply envelop the buttock lower portion as shown in FIG. 7. This cooperates with the function of rubber tapes 37 stitched to the peripheries of leg openings 36 to prevent rising of the hip hemlines 35 from a position C to a position D in FIG. 8, from occurring. The rise may occur when the posture of a person is changed from a standing posture to a sitting posture, a bending or crouching posture, or the like.

As shown in FIG. 7, in a worn state, seamlines L of the right and left edges 34, 34 of the back body 33, and the right and left edges 32, 32 of the front body 31 are formed so as to reach the hip hemlines 35 with outward detouring around the tops T of the buttocks. According to the configuration, loose wrinkles and bagginess in portions of the shorts or the like corresponding to the buttock lower portion and the gluteal groove portion are hardly produced in a standing posture, and a beautiful hip hemline is obtained.

Patent literature 1: Japanese Patent No. 3,389,573

DISCLOSURE OF THE INVENTION

Problems to be Solved by the Invention

However, the clothing such as shorts or a bathing suit attains a certain effect of preventing the hip hemline from rising, but it is noted that the clothing lacks in continuousness and stability of the rising prevention state. It is considered that there are two causes of the above. One of the causes is that the force of the rubber tapes 37 having polyurethane elastic yarns stitched to the peripheries of the leg openings 36 to prevent rising from occurring is gradually weakened with time. The other cause is that it is not sufficient for alone the range (in FIG. 5, A1) of the three-dimensional effect obtained by: forming the lower end portions of the right and left edges 32, 32 of the front body 31 into the curved edges 32*a* that are outward convex; cutting the lower portions 34*a* of the right and left edges 34, 34 of the back body 33 into a shape which is spread as moving downward, the portions extending from vertical intermediate portions to lower end portions; and stitching the both portions 32*a*, 34*a* to each other, to exert a cushion effect corresponding to an intensive shape change of the buttock due a motion of the human body, on the pattern in the vicinity of the buttock lower portion.

Namely, in the rubber tapes 37 having polyurethane elastic yarns stitched to the peripheries of the leg openings 36, the effect of preventing the hip hemlines 35 from rising after bending or stretching of the human body is weakened with elapse of time. The three-dimensionalizing dart effect of the pattern in the vicinity of the buttocks causes the cloth of the shorts or the like in the portion to be pulled, and also the rubber tapes 37 to be pulled, whereby a force (tension) of retracting the rubber tapes 37 is applied. However, the force of retracting the rubber tapes 37 is gradually weakened by the phenomenon that, when the buttock shape change is intense as in the case of bending or stretching of the human body, the rubber tapes 37 which extends in accordance with the application of the force of strongly pulling the cloth in the tops T of the buttocks remains for a long time in a state where the tapes themselves are stretched. In the rubber tapes 37 in a worn state, the retracting force is weakened also by a temperature rise due to the body temperature. These are causes of reduction of the continuousness of the rising prevention state.

In the clothing such as shorts, tension is applied by extending the cloth in the portions A1 in the buttock lower portion, and also by stretching the rubber tapes 37. As shown in FIG. 6, after the curvature of a rear end portion 38*b* of a gusset 38 which is formed into a convex arcuate shape is made equal to or substantially equal to that of an inner crotch rear portion 39 which is formed in the lower end of the back body 33 into a concave arcuate shape, the rear end portion 38*b* and the inner crotch rear portion 39 are stitched together. In the hip hemlines 35, 35, therefore, the vicinity of an intersecting portion which intersects with seamlines of the rear end portion 38*b* and the inner crotch rear portion 39 lacks in stereoscopic effect and adhesiveness to the buttock lower portion. Consequently, the tension of the rubber tapes 37 tends to be relaxed, and the continuousness and stability of the rising prevention state of the hip hemlines 35 are lowered.

In the clothing such as shorts, in order to absorb the buttock shape change when the human body is bent, it is necessary to use stretchable cloth. In the buttock lower portion, even when stretchable cloth is used, a force of gathering the cloth to a buttock middle portion, i.e., a force of stretchingly raising the cloth in a fully-stretched manner acts. However, the cushion effect of relaxing the stretching force is weak, and hence the clothing lacks in continuousness and stability of the rising prevention state.

The invention has been conducted in order to solve the problems. It is an object of the invention to provide a clothing such as shorts or a bathing suit in which a dart is disposed in a stitched portion of a rear end portion of a gusset and an inner crotch rear portion of a back body, whereby continuousness and stability of the rising prevention state of hip hemlines can be improved.

Means for Solving the Problems

In order to assist the understanding of the contents of the invention, the invention will be described with reference to reference numerals used in FIGS. 1 to 4. In a clothing such as shorts or a bathing suit, the clothing comprises: a stretchable front body (11) in which leg openings (15) are formed in a bilaterally symmetrical manner; a stretchable back body (12); and a gusset (13) which is disposed between an inner crotch front portion (22) of a lower end of the front body (11) and an inner crotch rear portion (23) of a lower end of the back body (12), to cover a groin portion, right and left edges (16), (16) of the front body (11), and right and left edges (19), (19) of the back body (12) are stitched together, a front end portion (13*a*) of the gusset (13) is stitched to the inner crotch front portion (22) of the lower end of the front body (11), a rear end portion (13*b*) of the gusset (13) which is formed into a convex arcuate shape is stitched to the inner crotch rear portion (23) which is formed in the lower end of the back body (12) into a concave arcuate shape, and a stretchable strip- or string-like material (28) is disposed in peripheries of the leg openings (15). A curvature of the rear end portion (13*b*) which is formed in the gusset (13) into a convex arcuate shape is made larger than a curvature of the inner crotch rear portion (23) which is formed in the lower end of the back body (12) into a concave arcuate shape, and the rear end portion (13*b*) and the inner crotch rear portion (23) are stitched together to dispose a dart (26) which three-dimensinalizes so as to suit a bulged shape of a buttock lower portion.

In this case, the leg openings (15) are formed into a downward opened shape, lower end portions of the right and left edges (16), (16) of the front body (11) intersect with lower end portions of hip hemlines (15*a*) of inner peripheries of the leg openings (15), respectively, portions of the right and left edges (16), (16) and extending from vertical intermediate positions to the lower end portions are cut in a form which is connected by a curved edge (16*a*) that is outward convex, portions (16*b*) of the curved edges (16*a*) which are lower than a vertical intermediate position are formed into a linear or curved shape, lower portions (19*a*) of right and left edges (19), (19) of the back body (12) are cut into a shape which is spread as moving downward, the portions extending from vertical intermediate positions to lower end portions, and seamlines (L) of the right and left edges (19), (19) of the back body (12), and the right and left edges (16), (16) of the front body (11) are formed so as to reach the hip hemlines (15*a*) with outward detouring from rear waist portions (20), (21) and tops (T) of buttocks.

EFFECTS OF THE INVENTION

According to the thus configured clothing such as shorts or a bathing suit, the curvature of the rear end portion of the gusset which is formed into a convex arcuate shape is made larger than that of the inner crotch rear portion which is formed in the lower end of the back body into a concave arcuate shape, and the rear end portion and the inner crotch rear portion are stitched together to dispose the dart which three-dimensinalizes so as to suit a bulged shape of a buttock lower portion. Therefore, the three-dimensionalization is enabled in a wide range B1 (see FIG. 1) in which a vicinity C1 (see FIG. 1) of an intersecting portion which, in the hip hemline, intersects with the seamline of the rear end portion of the gusset and the inner crotch rear portion of the back body is added to the range A1 of the three-dimensional effect obtained in the above-described conventional shorts shown in FIGS. 5 to 7 (B1=A1+C1), i.e., a wide range in which it is possible to sufficiently conform to the bulged shape of the buttock lower portion. Moreover, it is possible to design so that only the portion B1 is slightly small so as to enable the tension of the stretchable strip- or string-like material in peripheries of the leg opening to function effectively. Even when the slack of the stretchable strip- or string-like material is considered, therefore, it is possible to ensure tension which is sufficiently effective, and the rising prevention state of hip hemlines can be maintained.

In the buttock lower portion, when the human body is bent, a force of stretchingly raising the cloth in a fully-stretched manner so as to gather the cloth to a buttock middle portion acts. The stretching force can be absorbed and relaxed by the dart which is formed in a bulged shape in the stitched portion of the rear end portion of the gusset and the inner crotch rear portion of the back body. The cushion effect is further enhanced, and continuousness and stability of the rising prevention state of the hip hemlines can be improved.

DESCRIPTION OF REFERENCE NUMERALS

Figure 1:
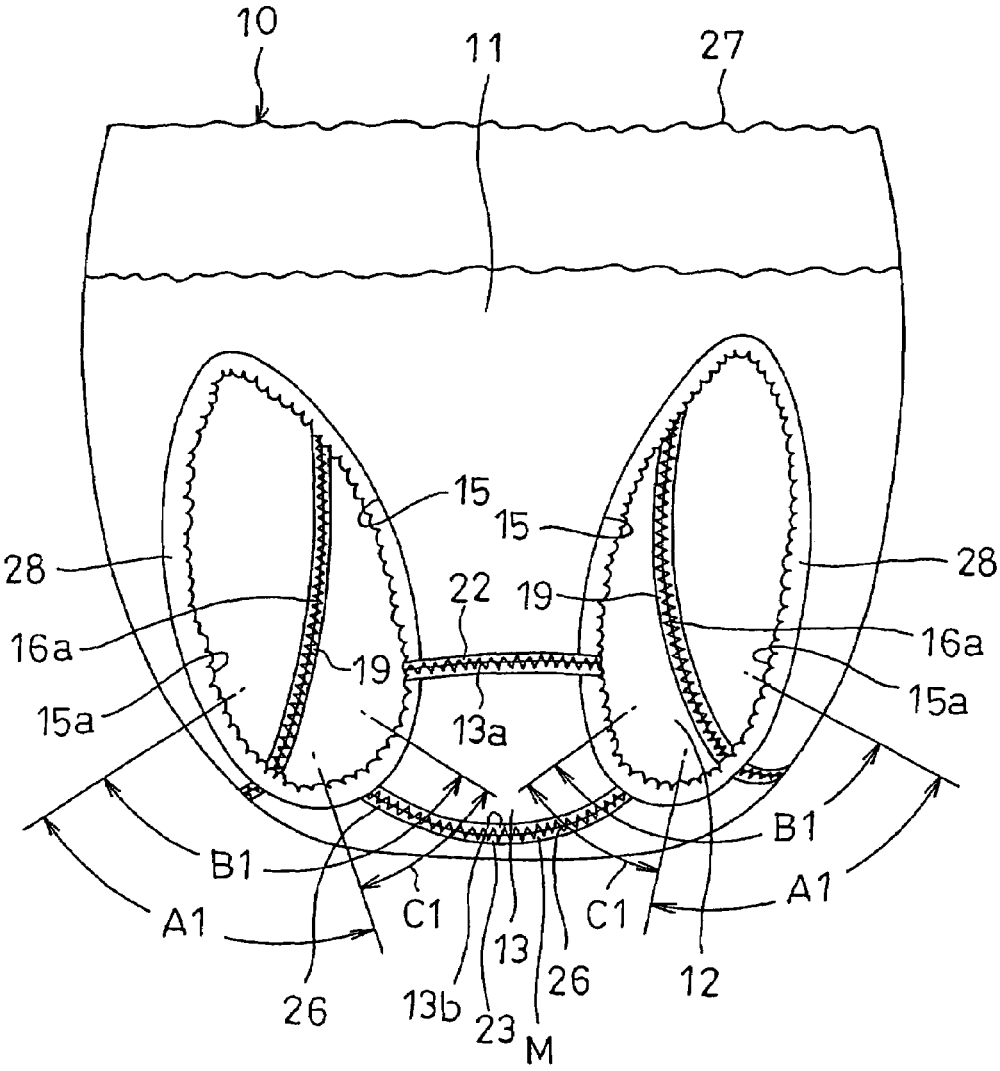
FIG. 1 is a front view of shorts of an embodiment of the invention.

11 front body
12 back body
13 gusset
13*a* front end portion of gusset
13*b* rear end portion of gusset
15 leg opening
15*a*, 15*a* hip hemline
16, 16 right and left edges of front body
16*a* curved edge
16*b* lower portion
19, 19 right and left edges of back body
19*a* lower portion
20, 21 rear waist portion
22 inner crotch front portion
23 inner crotch rear portion
26 dart
28 strip- or string-like material such as tape or lace
T top of buttock
L seamline of front body and back body

BEST MODE FOR CARRYING OUT THE INVENTION

Figure 2:
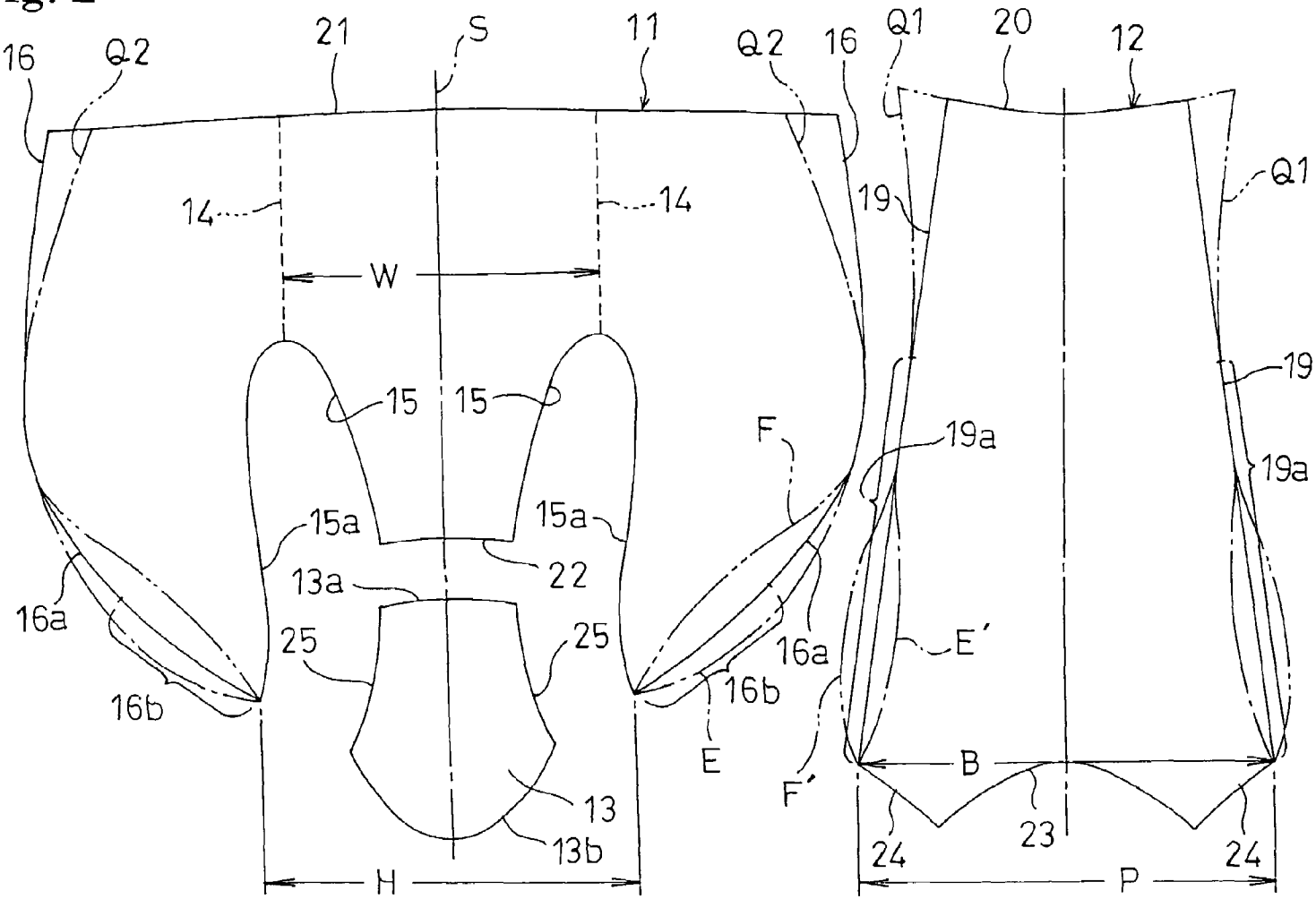
FIG. 2 is a development plan view of a front body, a back body, and a gusset of the shorts.
Figure 3:
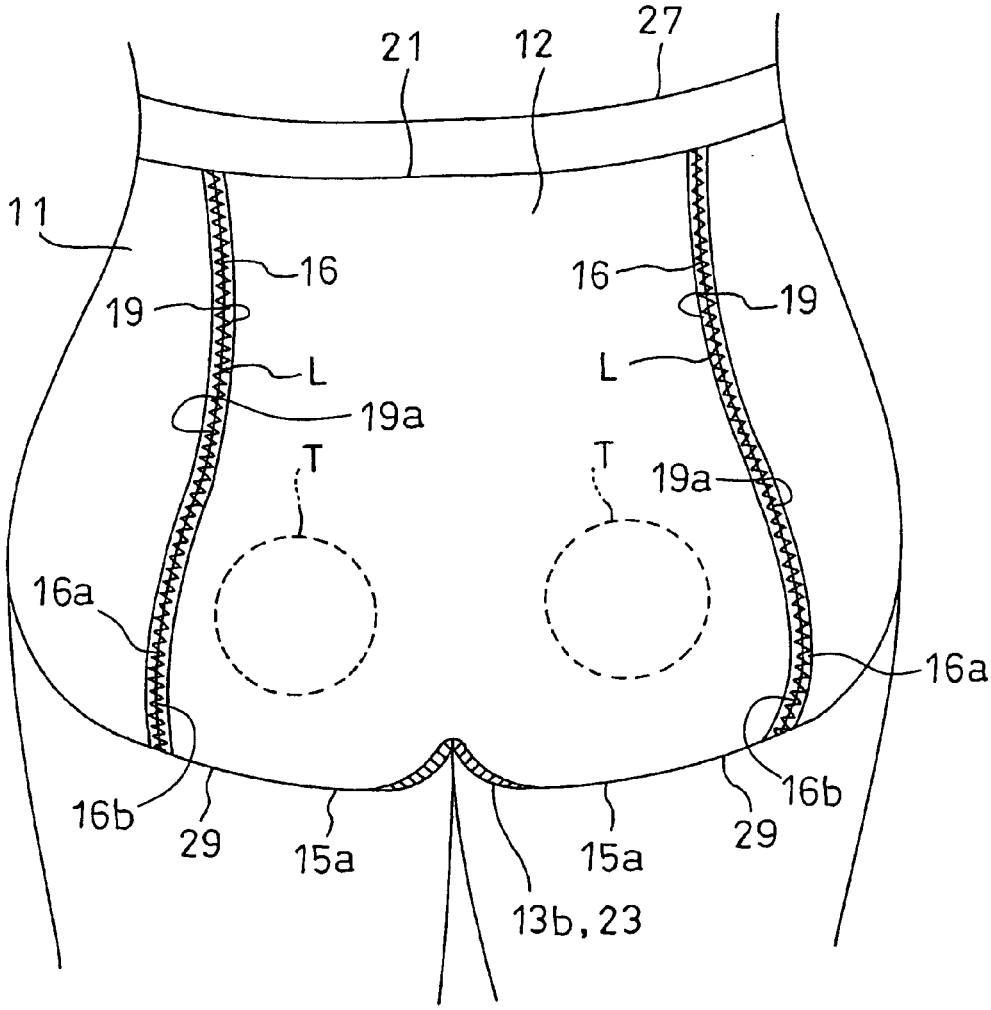
FIG. 3 is a rear view showing the shorts in a worn state.
Figure 4:
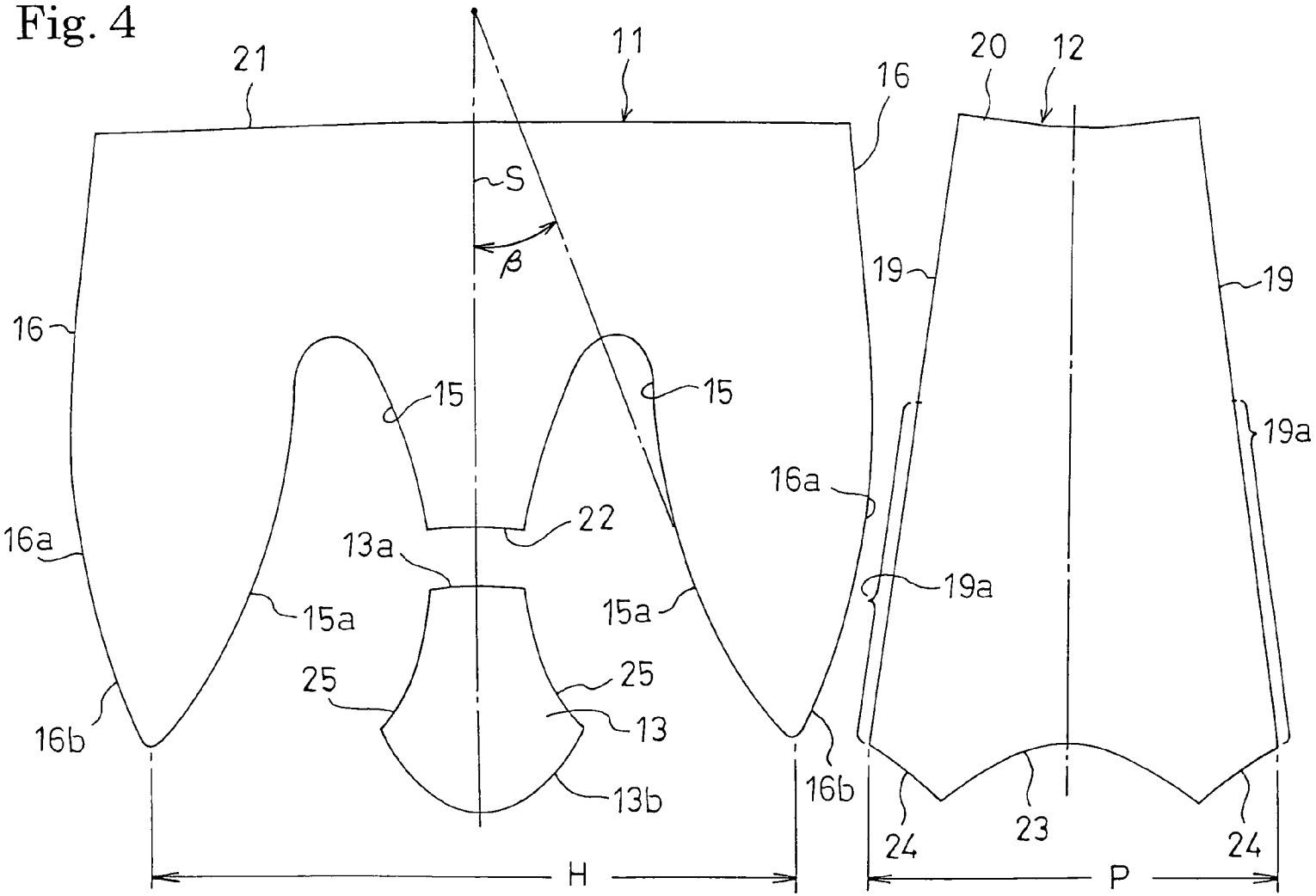
FIG. 4 is a development plan view of a front body, a back body, and a gusset of shorts of another embodiment of the invention.

FIG. 1 is a front view of shorts of an embodiment of the invention, FIG. 2 is a development plan view of a front body, a back body, and a gusset of the shorts, FIG. 3 is a rear view showing the shorts in a worn state, and FIG. 4 is a development plan view of a front body, a back body, and a gusset of shorts of another embodiment of the invention.

Referring to FIGS. 1 to 3, the shorts 10 which is an embodiment of the invention is configured by main component including: a front body 11 which is to cover the abdomen; a back body 12 which is to cover the buttocks; and a gusset 13 which is disposed between an inner crotch front portion of the lower end of the front body 11 and an inner crotch rear portion of the lower end of the back body 12, and which is to cover the groin portion. The front and back bodies 11, 12, and the gusset 13 are configured by stretchable cloth.

As shown in FIG. 1, the front body 11 is cut so as to have a width which is larger than the width W between side lines 14, 14. In the lower end portion of the front body, leg openings 15, 15 which are downward opened are formed by cutting in a bilaterally symmetrical manner. In the illustrated example, the cutting is deeply performed so as to form the leg openings 15 for high-cut legs in a down-ward opening shape. A hip hemline 15*a* which occupies a substantially rear half of the inner periphery of each of the leg openings 15 is formed in substantially parallel to the front center line S. Lower end portions of right and left edges 16, 16 of the front body 11 are formed so as to intersect with lower end portions of the hip hemlines 15*a*, 15*a* of the right and left leg openings 15, 15.

Figure 8:
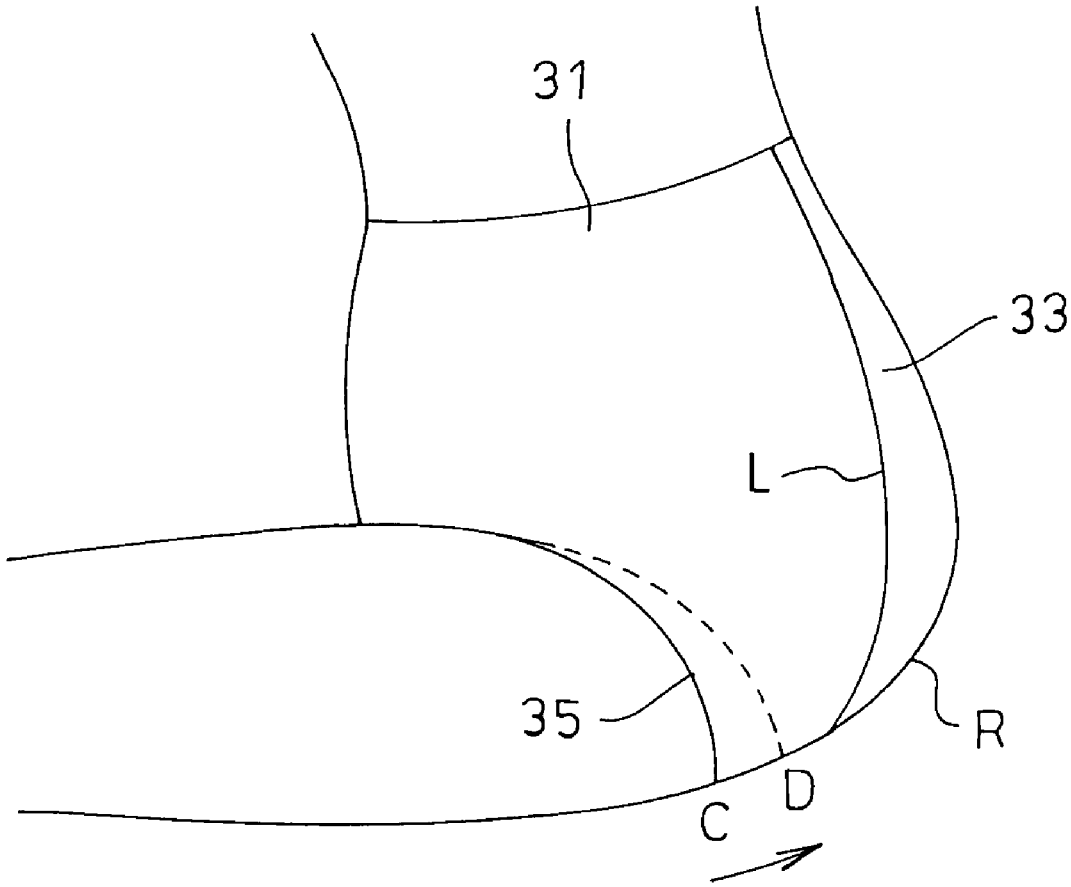
FIG. 8 is a side view showing a state where a person wearing shorts is in a sitting posture.

Portions of the right and left edges 16, 16 of the front body 11 and extending from vertical intermediate positions to the lower end portions are formed into arcuately curved edges 16*a* which are outward convex. The curves of the curved edges 16*a* are employed in order to form a shape which is similar as far as possible to a curve R of the buttock lower portion that is drawn when the wearer sits on a chair, as shown in FIG. 8. When the radius of the whole curved edges 16*a* is small, loose wrinkles are easily produced in the places in a standing posture. In order to solve this, preferably, portions 16*b* (portions covering places which are immediately above the gluteal groove portion) of the curved edges 16*a* which are lower than a vertical intermediate position are formed into a linear or gently curved shape.

On the other hand, the back body 12 is cut so that right and left edges 19, 19 of the back body are cut into an inclined shape which is gradually spread as moving downward. In this case, it is not always necessary to form the right and left edges 19, 19 into an inclined shape which is straight over the whole vertical length extending from a waist portion 20 to the lower end portion. It is requested that at least lower portions 19*a* extending from the vertical intermediate position to the lower end portion are cut into a shape which is spread as moving downward. For example, the portions may be arbitrarily formed as curves such as E and E' indicated by the single-dashed line in FIG. 2, or those such as F and F' indicated by the double-dashed line in the figure.

The portion of each of the right and left edges 19, 19 extending from the waist portion 25 to the vertical intermediate position can be arbitrarily drawn into an inclined line, a curved line, or the like. For example, the portion may be formed into an arcuate edge as indicated by the double-dashed line Q1 in FIG. 2. In this case, in accordance with the formation, the portion of each of the right and left edges 16, 16 of the front body 11 which extends from a waist portion 21 to the vertical intermediate position is cut as indicated by the double-dashed line Q2.

The front body 11 and the back body 12 which are cut in this way are formed into a tubular shape by stitching together the right and left edges 16, 16 and 19, 19. An inner crotch front portion 22 which is formed into a concave arcuate shape in the center of the lower end of the front body 11, and an inner crotch rear portion 23 which is similarly formed into a concave arcuate shape in the center of the lower end of the back body 12 are connected to each other by the gusset 13. At this time, a front end portion 13*a* which is formed into a convex arcuate shape in the gusset 13 is stitched to the inner crotch front portion 22 of the front body 11. A rear end portion 13*b* which is formed into a convex arcuate shape in the gusset 13 is stitched to the inner crotch rear portion 23 of the back body 12. The downward opening portions of the leg openings 15 of the front body 11 are connected in an endless manner by inclined lower edges 24 through which the lower ends of the lower portions 19*a* of the back body 12 and the inner crotch rear portions 23 are connected to each other, and right and left edges 25 of the gusset 13.

It should be noted that the rear end portion 13*b* which is formed into a convex arcuate shape in the gusset 13 is cut so that its curvature is larger than the curvature of the inner crotch rear portion 23 which is formed in the lower end of the back body 12 into a concave arcuate shape, and the rear end portion 13*b* and the inner crotch rear portion 23 are stitched together to dispose a dart 26 which three-dimensinalizes so as to suit a bulged shape of the buttock lower portion. The disposition of the dart 26 causes a bulge having a shape in which the vicinity of the lateral middle of a seamline M of the rear end portion 13*b* and the inner crotch rear portions 23 is highest and slightly outward rises, to be formed along the seamline M.

Figure 5:
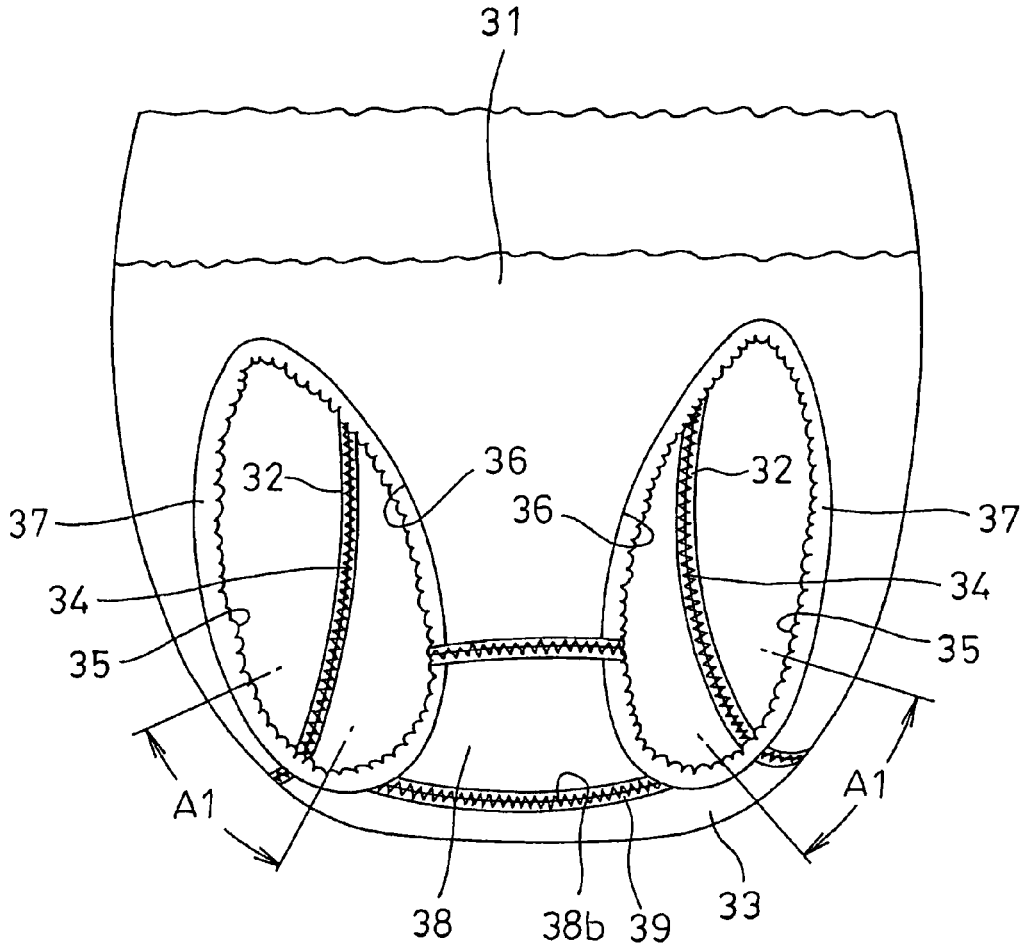
FIG. 5 is a front view of shorts of a conventional example.
Figure 6:
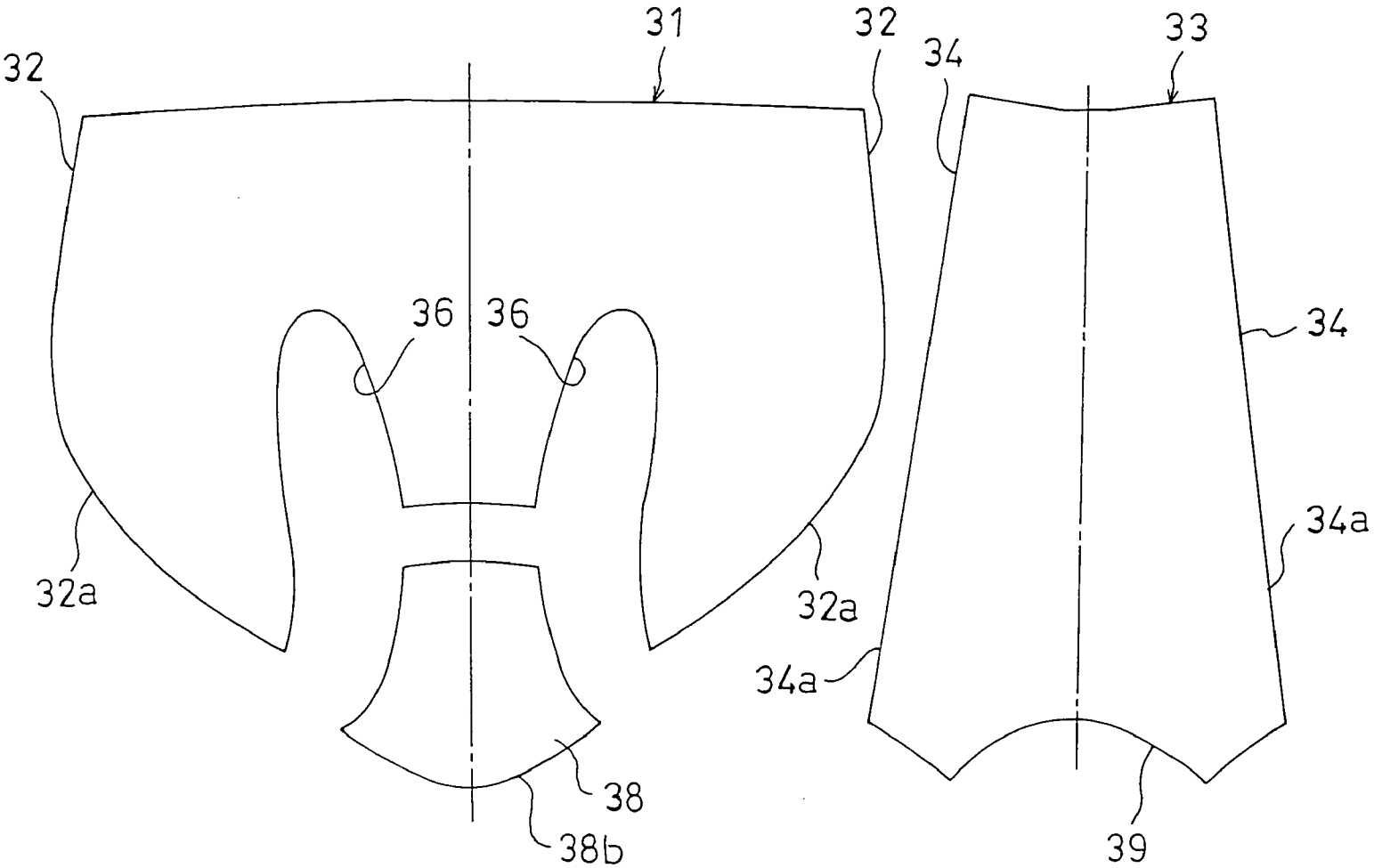
FIG. 6 is a development plan view of a front body, a back body, and a gusset of the shorts of FIG. 5.
Figure 7:
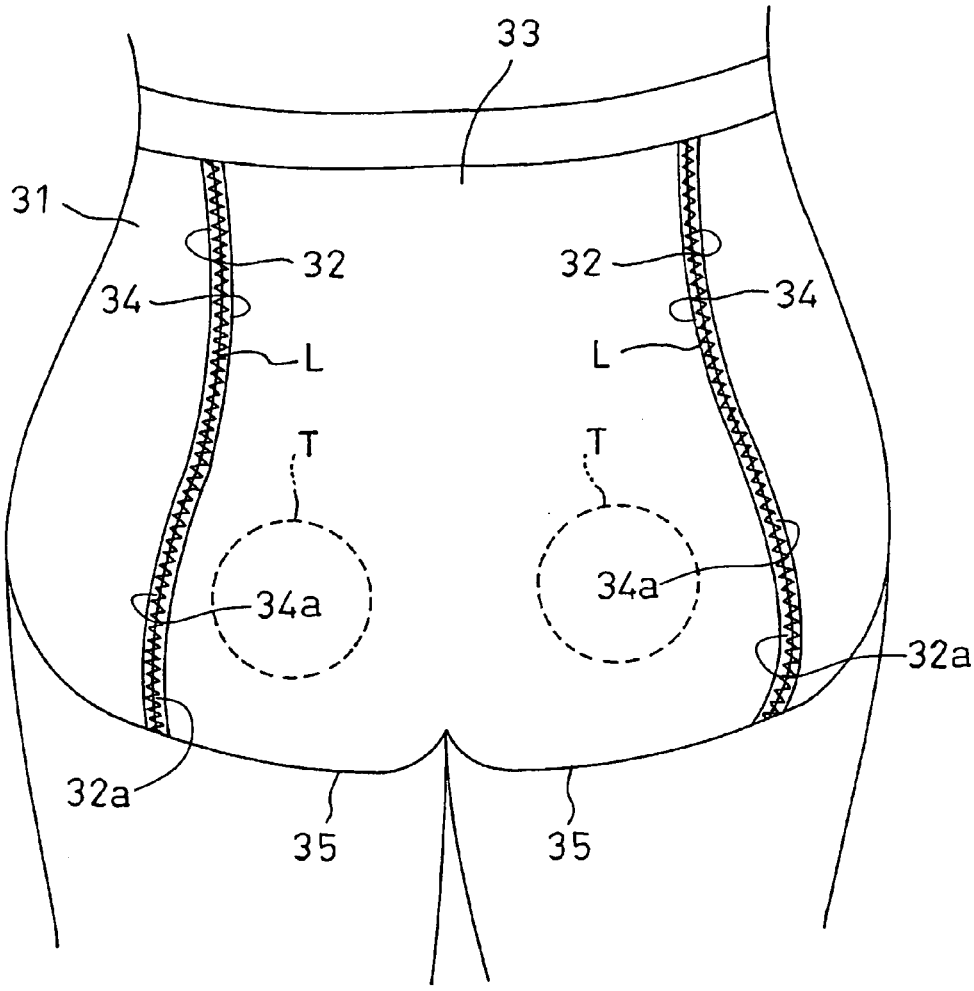
FIG. 7 is a rear view showing the shorts of FIG. 5.

When the dart 26 is disposed in this way, the three-dimensionalization is enabled in a wide range B1 in which a vicinity C1 of an intersecting portion which intersects with the seamline M of the hip hemlines 15*a* as shown in FIG. 1 is added to the range A1 of the three-dimensional effect obtained in the conventional shorts shown in FIGS. 5 to 7 (in which the curved edges 32*a* of the lower end portions of the right and left edges 32, 32 of the front body 31 are stitched to the lower portions 34*a* having a downward spread shape in the right and left edges 34, 34 of the back body 33, and the rear end portion 38*b* of the gusset 38 and the inner crotch rear portion 39 of the back body 33 that have the same curvature). The three-dimensionalization is enabled in the wide range where it is possible to sufficiently conform to the bulged shape of the buttock lower portion.

As shown in FIG. 3, seamlines L of the right and left edges 16, 16 of the front body 11, and the right and left edges 19, 19 of the back body 12 are formed so as to, in a worn state, elongate from places outside the back waist portions 21, 20 to outward detour around the top T of the buttock and then reach the hip hemline 15*a*. In order to realize this, as shown in FIG. 2, the width P between the lower end portions of the right and left edges 19, 19 of the back body 12 is set to be equal to or larger than 0.6 times and equal to or smaller than 4 times the width H between the lower end portions of the right and left edges 16, 16 of the front body 11. In FIG. 2, the widths P and H are set to be approximately equal to each other.

Stretch lace 27 is stitched to the waist portions 21, of the front body 11 and the back body 12.

A strip- or string-like material 28 such as a stretchable tape or lace is disposed by stitching to peripheries of the leg openings 15. When a tensional force is weak, a fitting force of a hip hemline against the gluteal groove portion is so weak that the effect of pre-venting the hip hemlines 15*a* from rising is hardly obtained. When a tensional force is excessively strong, the effect of preventing the hip hemlines 15*a* from rising is enhanced, but the wearing feeling is impaired. In the strip- or string-like material 28, therefore, an adequate tensional force is required. The tensional force means a force which is obtained by applying the testing method of JIS-L-1018, using a constant-rate extension type tensile tester, and, for example, extending a test specimen having a measurement spacing of 10 cm to 18 cm and retracting it to 15 cm.

In the strip- or string-like material 28, in a tensional force test at a set extension degree of 80%, a preferred range of a tensional force of 50% is 0.3 to 7 N (Newtons), and more preferably 1.5 N. An example of the strip- or string-like material 28 of a tensional force of 1.5 N is a material formed by using eight or more polyurethane elastic yarns of 140 denier or more, or five or more polyurethane elastic yarns of 280 denier or more.

In the thus sewn shorts 10, the lower end portions of the right and left edges 16, 16 of the front body 11 are formed into the curved edges 16*a* which are outward convex, the lower portions 19*a* extending from the vertical intermediate positions of the right and left edges 19, 19 of the back body 12 to the lower end portion are cut into a shape which is spread as moving downward, and the both portions 16*a*, 19*a* are stitched to each other. In the vicinity of the hip hem, therefore, adequate three-dimensional bulges which are similar to the body shape of the buttock lower portion and the gluteal groove portion are formed. As shown in FIG. 3, consequently, the hip hemlines 15*a* can deeply fit to the gluteal groove portion 29 of the buttock to deeply envelop the buttock lower portion, so that, even when the wearer moves, for example, sits on a chair or vigorously bends at the waist, the hip hemlines 15*a* can be surely prevented from rising.

The curvature of the rear end portion 13*b* which is formed into a convex arcuate shape in the gusset 13 is larger than that of the inner crotch rear portion 23 which is formed in the lower end of the back body 12 into a concave arcuate shape, and the rear end portion 13*b* and the inner crotch rear portion 23 are stitched together to dispose the dart 26 which three-dimensinalizes so as to suit a bulged shape of the buttock lower portion. As described above, therefore, the three-dimensionalization is enabled in the wide range B1 in which the vicinity C1 of an intersecting portion which intersects with the seamline M of the hip hemlines 15*a* as shown in FIG. 1 is added to the range A1 of the three-dimensional effect obtained in the conventional shorts shown in FIGS. 5 and 6, i.e., in the wide range where it is possible to sufficiently conform to the bulged shape of the buttock lower portion. Moreover, it is possible to design so that only the portion B1 is slightly small so as to enable the tension of the stretchable strip- or string-like material 28 in peripheries to function effectively. Even when the slack of the strip- or string-like material 28 is considered, therefore, it is possible to ensure tension which is sufficiently effective, and continuousness and stability of the rising prevention state of the hip hemlines 15*a* can be improved.

In the buttock lower portion, when the human body is bent, a force of gathering the cloth to a buttock middle portion (a force of stretchingly raising the cloth in a fully-stretched manner) acts. The stretching force can be absorbed and relaxed by the dart 26 which is formed in a bulged shape in the stitched portion of the rear end portion 13*b* of the gusset 13 and the inner crotch rear portion 23 of the back body 12. The cushion effect is enhanced, and continuousness and stability of the rising prevention state of the hip hemlines are excellent.

The seamlines L of the front body 11 and the back body 12 outward detours around the buttock top T so as to avoid the top. Even when a pattern in which the hip hemline is downward elongated so as to deeply envelop the buttock lower portion is employed, therefore, loose wrinkles and bugginess in the buttock lower portion and the gluteal groove portion are hardly produced in a standing posture, and the buttocks can be enveloped widely and deeply, unlike the case where the seamlines L of the front body 11 and the back body 12 pass over the buttock top T.

Since the seamlines L of the front body 11 and the back body 12 outward detour so as to avoid the buttock top T, the stretchability of the cloth itself of the buttock top T of the back body 12 can be ensured. This stretchability enables the clothing to satisfactorily cope with vigorous motion of the buttock top T. Therefore, the length and the size of the dart required for preventing the rising can be made smaller than those of a dart required in the case where the seamlines L of the back body 30 pass over the buttock top T. As a result, in a standing posture, loose wrinkles and bugginess are hardly produced in the buttock lower portion and the gluteal groove portion, and the beautiful hip hemline 15*a* can be obtained. Furthermore, a sense of discomfort due to the seamlines L is hardly produced even in a sitting posture. Even when a person wears an outer garment which is tight and thin, lines elongating along the seamlines L appear in a less prominent manner on the outer garment as compared with the case where the line passes the highest top T of the buttock.

FIG. 4 is a development plan view of a front body, a back body, and a gusset of shorts of another embodiment of the invention. In the embodiment, the whole curved edges 16*a* of the front body 11 are formed by curves which are relatively gentler than the curves of the whole curved edges 16*a* of the above-described embodiment. In contrast to the above-described embodiment in which the hip hemlines 15*a* of the leg openings 15 are formed in substantially parallel to the front center line S, in the embodiment, the hip hemlines 15*a* of the leg openings 15 of the front body 11 are formed to be substantially symmetrical with the curved edges 16*a*, and an angle β formed by the front center line S and an extended line of each of the hip hemlines 15*a* is set to 40° or smaller, more preferably 35°. The width P between the lower end portions of the right and left edges 19, 19 of the back body 12 is set to be about 0.65 times the width H between the lower end portions of the right and left edges 16, 16 of the front body 11. The other points such as the shape of the back body 12, that the dart 26 is disposed in the stitched portion of the rear end portion 13*b* of the gusset 13 and the inner crotch rear portion 23 of the back body 12, and that, in a worn state, the seamlines L of the front and back bodies 11, 12 elongate from places outside the back waist portions to outward detour around the top T of the buttock so as to avoid the top are configured in the strictly same manner as the above-described embodiment.

In the shorts of the embodiment also, the effects that the hip hemlines 15*a* can be surely prevented from rising, and that continuousness and stability of the rising prevention state can be improved can be attained in the same manner as the above-described embodiment.

The clothing of the invention is not restricted to shorts, and may be similarly applied to a bathing suit, a leotard, or the like, and may be similarly applied also to briefs for men.

The invention claimed is:

1. A clothing such as shorts or a bathing suit in which the clothing comprises: a stretchable front body (11) in which leg openings (15) are formed in a bilaterally symmetrical manner; a stretchable back body (12); and a gusset (13) which is disposed between an inner crotch front portion (22) of a lower end of said front body (11) and an inner crotch rear portion (23) of a lower end of said back body (12), to cover a groin portion, right and left edges (16), (16) of said front body (11), and right and left edges (19), (19) of said back body (12) are stitched together, a front end portion (13*a*) of said gusset (13) is stitched to said inner crotch front portion (22) of the lower end of said front body (11), a rear end portion (13*b*) of said gusset (13) which is formed into a convex arcuate shape is stitched to said inner crotch rear portion (23) which is formed in the lower end of said back body (12) into a concave arcuate shape, and a stretchable strip- or string-like material (28) is disposed in peripheries of said leg openings (15), wherein a curvature of said rear end portion (13*b*) which is formed into a convex arcuate shape in said gusset (13) is made larger than a curvature of said inner crotch rear portion (23) which is formed in the lower end of said back body (12) into a concave arcuate shape, and said rear end portion (13*b*) and said inner crotch rear portion (23) are stitched together to dispose a dart (26) which three-dimensinalizes so as to suit a bulged shape of a buttock lower portion.

2. A clothing such as shorts or a bathing suit according to claim 1, wherein said leg openings (15) are formed into a downward opened shape, lower end portions of said right and left edges (16), (16) of said front body (11) intersect with lower end portions of hip hemlines (15*a*) of inner peripheries of said leg openings (15), respectively, portions of said right and left edges (16), (16) and extending from vertical intermediate positions to the lower end portions are cut in a form which is connected by a curved edge (16*a*) that is outward convex, portions (16*b*) of said curved edges (16*a*) which are lower than a vertical intermediate position are formed into a linear or curved shape, lower portions (19*a*) of right and left edges (19), (19) of said back body (12) are cut into a shape which is spread as moving downward, said portions extending from vertical intermediate positions to lower end portions, and seamlines (L) of said right and left edges (19), (19) of said back body (12), and said right and left edges (16), (16) of said front body (11) are formed so as to reach said hip hemlines (15*a*) with outward detouring from rear waist portions (20), (21) and tops (T) of buttocks.

* * * * *